United States Patent [19]

Zecman

[11] Patent Number: 4,678,429

[45] Date of Patent: Jul. 7, 1987

[54] DIE CASTING TORCH

[76] Inventor: Kenneth P. Zecman, P.O. Box 39009, Redford, Mich. 48239

[21] Appl. No.: 775,146

[22] Filed: Sep. 12, 1985

[51] Int. Cl.[4] ..... F23Q 25/00

[52] U.S. Cl. ..... 431/144; 431/350; 431/346; 239/432

[58] Field of Search ..... 431/144, 158, 344, 353, 431/354, 33, 345, 346, 350; 239/430, 432; 169/54

[56] References Cited

U.S. PATENT DOCUMENTS

| | | | |
|---|---|---|---|
| 1,595,995 | 8/1926 | Clefton | 431/346 |
| 2,367,119 | 1/1945 | Hess | 431/158 |
| 2,618,322 | 11/1952 | Conta et al. | 239/430 |
| 3,945,440 | 3/1976 | Bohme | 169/54 |

*Primary Examiner*—Margaret A. Focarino
*Attorney, Agent, or Firm*—Krass & Young

[57] ABSTRACT

A torch tip for use with a die casting torch in which the tip functions to blow out the flame when the ratio of air pressure to gas pressure being supplied to the tip exceeds a predetermined safe value. The torch tip comprises a unitary die casting and includes a generally cylindrical main body portion, a partition extending transversely between the ends of the main body portion, a reduced diameter mouth at the discharge end of the main body portion having a diameter that is less than the internal diameter of the main body portion at the partition, and a plurality of holes in the partition including at least some holes spaced radially outwardly of the circumferential boundary of the reduced diameter mouth. The reduced diameter mouth and the radially outwardly disposed holes in the diaphragm coact to create a turbulent burn condition which may be selectively controlled to provide burn out of the flame at a precise ratio of air pressure to gas pressure so that the operator of the die casting apparatus is unable to increase the flame temperature beyond the safe temperature corresponding to the predetermined ratio of air pressure to gas pressure.

12 Claims, 4 Drawing Figures

DIE CASTING TORCH

TECHNICAL FIELD

This invention relates to torches for use in die casting applications and more particularly to an improved tip for a die casting torch.

BACKGROUND OF THE INVENTION

In a typical die casting application, a charge of molten metal is delivered from a shot barrel through a gooseneck passage and through a nozzle to the mold cavity where the die cast parts are formed. It is critical to maintain the metal in a liquid state as it flows from the shot barrel to the mold cavity and it is particular critical to maintain the metal in a molten state as it moves through the gooseneck passage and the die casting nozzle. The metal is typically maintained in a molten state as it moves from the shot barrel to the mold cavity by the use of one or more torches which are directed against the gooseneck passage and against the nozzle to ensure that the flowing metal is maintained at a temperature above its melting temperature. These torches typically burn a mixture of a combustible gas, such as methane, and air. Rarely is this mixture controlled to burn at a ratio less than 10 to 1. When $CH_4$ is burned at an air to gas pressure ratio less than 10 to 1 the temperature of the flame is lowered proportionately. It is common place to use the high range of the flame temperature. Specifically in an attempt to speed up production or otherwise optimize the die casting operation, the operator commonly increases the air pressure to an extent such that the flame temperature becomes so great as to cause localized erosion of the metal along the central bore of the nozzle and/or so as to heat the molten metal to a temperature well above the temperature required to maintain it in a molten state with the result that the cooling time for the cast article becomes excessive.

Various attempts have been made in the past to limit the ability of the operator to increase the air pressure to an undesirably high level but such prior art attempts have either been ineffective in preventing the operator from increasing the air pressure or have been so expensive or complicated as to be impractical.

SUMMARY OF THE INVENTION

The present invention is directed to the provision of a die casting apparatus in which simple and effective means are provided for limiting the temperature of the heat delivered to the nozzle of the die casting apparatus by the heating torch.

According to the invention, the die casting apparatus includes means which are operative to extinguish the flame emitted from the torch in response to an increase in the ratio of the air pressure to the gas pressure beyond a predetermined value so that, if an operator attempts to increase the air pressure beyond an optimum value, the torch is automatically extinguished.

According to a feature of the invention, the torch includes an elongated tubular tip having a transverse partition between its ends and the tip includes means defining a mouth at the discharge end of the tip having a diameter that is less than the inner diameter of the tip at the partition. With this arrangement, when the ratio of air pressure to gas pressure is increased beyond a predetermined ratio, the reduced diameter mouth of the torch tip forces the flame away from the face of the torch and results in the flame blowing out. Specifically, the ratio of the diameter of the mouth to the diameter of the torch tip at the partition can be carefully controlled to produce a flame blowout at a precisely defined ratio of air pressure to gas pressure.

According to a further feature of the invention, a plurality of holes are provided in the partition positioned radially outwardly from the circumferential boundary of the mouth. These radially outwardly disposed holes have the effect of increasing the turbulence of the gas mixture between the partition and the mouth of the tip and coact with the reduced diameter mouth of the tip to produce the desired flame blowout. Thus, the number and spacing of these radially outwardly disposed holes and the particular diameter of the mouth of the tip can be selectively varied to cause the gas to travel further before primary combustion occurs and define the ratio of air pressure to gas pressure at which the torch will blow out.

According to a further feature of the invention, the inner diameter of the main body portion of the torch tip decreases gradually but rapidly in diameter from a region downstream of the partition to the mouth of the tip. This arrangement causes the gases in the flame emitting from the tip to cross over at a point immediately forwardly of the mouth of the tip to create an area of inefficient burn to facilitate the blowout process. The blow out is attributable to a variety of gas/air streams flowing across a common point with each stream having a different velocity and consequently a different pressure. In the disclosed embodiment of the invention, the torch tip is machined from a steel bar with internal threads in the inlet end of the tip and with the annular end surface surrounding the mouth of the tip defining a sharp edge with the inner circumferential surface of the tip to form a sharp edged orifice.

DETAILED DESCRIPTION OF THE PREFERRED EMBODIMENT

Figure 1:
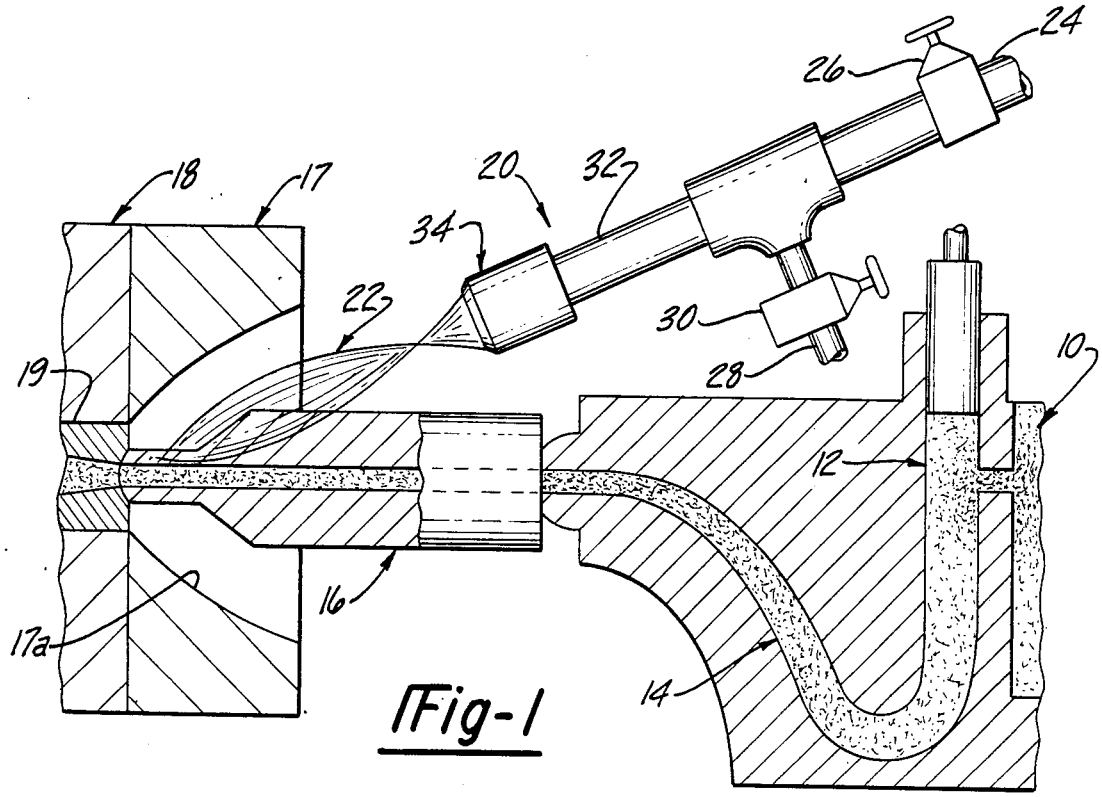
FIG. 1 is a schematic view of a die casting apparatus according to the invention.
Figure 2:
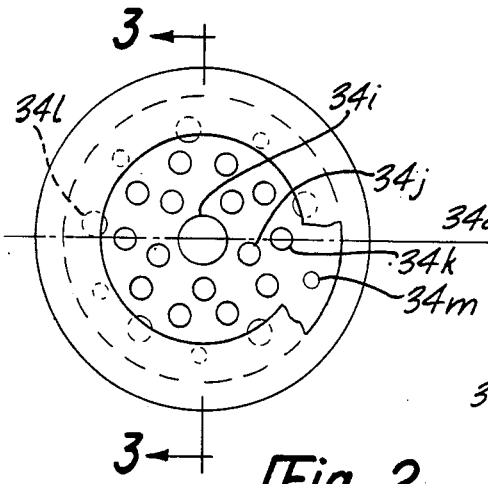
FIG. 2 is a end view of a torch tip employed in the die casting apparatus of FIG. 1.
Figure 3:
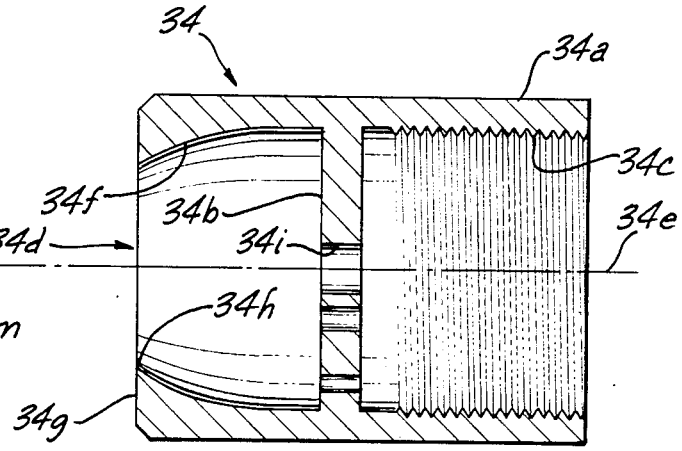
FIG. 3 is a cross-sectional view taken on lines 3—3 of FIG. 2.

The die casting torch of the invention is adapted for use with a die casting apparatus of the type including a source of molten metal 10, a shot barrel 12, a gooseneck 14, a nozzle 16, a die platen 17, a mold 18 and a die bushing 19. In known manner, molten metal from the bath 10 is ejected from the shot barrel 12 and through the gooseneck 14 into and through the nozzle 16 for injection into the mold 18 to form the die cast parts. In order to ensure that the metal is maintained in a molten state during its movement through gooseneck 14 and nozzle 16, a die casting torch 20, according to the invention, is positioned to direct its flame 22 against the nozzle 16 to heat the nozzle and prevent freeze-ups of the die casting metal. It will be understood that another die casting torch, not shown, will typically be directed against the gooseneck 14 to prevent freeze-ups in the gooseneck passage.

The invention die casting torch includes a supply pipe 24 communicating with a source of air under pressure; a pressure regulator 26 to control the pressure at which the air is delivered to the torch assembly; a supply pipe 28 for delivery of a pressurized gas such as methane to the invention torch; a pressure regulator 30 for controlling the pressure, if necessary, at which the gas is delivered to the torch; a supply pipe 32 for delivering a mixture of air and gas to the torch, and a torch tip 34 secured to the discharge end of supply pipe 32.

Torch tip 34 is preferably machined and includes a tubular main body portion 34*a* and a central partition portion 34*b* disposed intermediate the ends of the tip. Main body portion 34*a* is generally cylindrical and includes internal threads 34*c* at its inlet end for threaded coaction with external threads 32*a* on supply pipe 32 and further defines a mouth 34*d* at the discharge end of the torch tip.

Mouth 34*d* is centered on the longitudinal axis 34*e* of the torch tip and has a reduced diameter with respect to the diameter of main body portion 34*a* at partition 34*b*. For example, for a torch tip having an outside diameter of 1.180 inches and an inside diameter of 0.900 inches, the diameter of mouth 34*d* may be 0.740 inches. The diameter of the inner circumferential surface of main body portion 34*a* decreases gradually but rapidly from the downstream side of partition portion 34*b* to mouth 34*d* and preferably defines a smooth annular surface 34*f* which is generally arcuate in longitudinal cross section. Surface 34*f* intersects the annular surface 34*g* surrounding mouth 34*d* at an acute angle to form a sharp edge 34*h* around the circumference of the mouth.

Partition portion 34*b* has a plurality of holes for passage of the air/gas mixture supplied by pipe 32 including a relatively large diameter central hole 34*i* and a plurality of smaller holes positioned on circles that are concentric with central axis 34*e*. Specifically, partition 34*b* includes a first circumferentially spaced series of intermediate diameter holes 34*j*, a second circumferentially spaced series of intermediate diameter holes 34*k* positioned radially outwardly of holes 34*j*, a third series of intermediate diameter holes 34*l* positioned radially outwardly of holes 34*k*, and a fourth series of relatively small diameter circumferentially spaced holes 34*m* disposed on the same radius as intermediate diameter holes 34*l*. Intermediate diameter holes 34*l* and small diameter holes 34*m* are disposed radially outwardly of the circumferential boundary of mouth 34*d*. For example, and with an outer main body diameter of 1.18, an inner main body diameter of 0.90 and a mouth diameter of 0.740, central large diameter hole 34*i* may have a diameter of 0.156 inches; intermediate diameter holes 34*j*, *k* and *l* may have a diameter of 0.090 inches and may be positioned respectively on 0.35, 0.60 and 0.80 diameter circles; and small diameter holes 34*m* may be positioned on the 0.80 circle and have a diameter of 0.076 inches.

Figure 4:
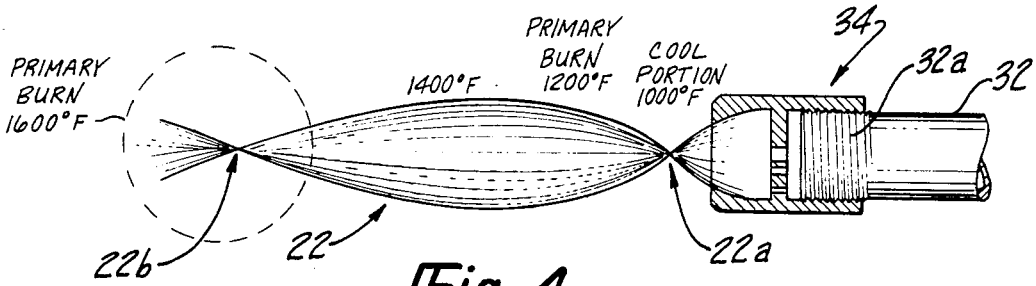
FIG. 4 is a fragmentary view showing the nature of the flame generated by the torch tip of the invention die casting apparatus.

The described torch tip construction, and in particular the described reduced diameter mouth in combination with the partition holes 34*l* and *m*, creates the torch or flame profile seen in operation in FIG. 1 and in zoned detail in FIG. 4. The torch or flame 22 as seen in FIG. 4 includes a relatively cool portion immediately in front of the mouth of the tip at which the flaming fuel/air mixture crosses over at a cross over point 22*a*; a preliminary burn portion downstream from the cool portion; and a primary burn portion at the distal end, or tip 22*b*, of the flame at which the fuel layers recross.

The temperature at which a gas mixture burns is determined by the ratio of the air pressure to the pressure of the combustible gas. Specifically, for a mixture of air and methane, the relationship of the flame temperature to the ratio of the air pressure to gas pressure is shown by the following table.

| Ratio of Air Pressure to Gas Pressure | Approximate Primary Burn Temperature (Degrees Fahrenheit) |
|---|---|
| 10:1 | 2000 |
| 9:1 | 1900 |
| 8:1 | 1800 |
| 7:1 | 1700 |
| 6:1 | 1600 |
| 5:1 | 1500 |
| 4:1 | 1400 |
| 3:1 | 1300 |
| 2:1 | 1200 |

Thus, for example, with an air pressure to gas pressure ratio of 6:1, the temperature of the resulting flame in the primary burn area will be approximately 1600° F. According to the invention, the torch tip is designed specifically to cause the flame to extinguish or blow out when a predetermined maximum ratio of air pressure to gas pressure, corresponding to a predetermined maximum flame temperature in the primary burn region, is reached. For example, if it is determined that 1600° F. is the maximum desired temperature in the primary burn region of the torch flame so as to minimize erosive damage to the nozzle and to avoid wasteful overheating of the molten metal, the diameter of the mouth of the torch tip and the location and sizes of the holes in the partition of the torch tip are chosen to cause the flame to automatically extinguish when an attempt is made to increase the air pressure to gas pressure ratio above 6:1.

The nozzle tip effectively creates a blowout point for the torch. For example, the previously disclosed mouth, main body and hole dimensions have been found to cause the flame to always blow at approximately 1600° F. When the operator attempts to increase the air pressure above the desired or predetermined 6:1 ratio, the flame is forced away from the face of the torch and the flame blows out. The lip at the mouth of the torch accelerates a portion of the fuel mixture, by drastically reducing the area through which it flows. As this portion of the gas mixture is accelerated, it drops in pressure. The reduced diameter mouth of the torch thus causes turbulent flow of gas immediately forwardly of the tip and, specifically, creates the cross over point 22*a* immediately forwardly of the tip at which an inefficient burn occurs. The flame in this area is thus relatively unstable and is subject to blowout in the event that the operator attempts to increase the air pressure to a value that would create an air pressure to gas ratio in excess of the desired predetermined valve.

Whereas it has been found that the reduced diameter mouth portion alone is effective to create the desired blowout condition, it has further been found that the blowout ratio of the torch tip can be even more carefully and precisely controlled by careful control of the size and placement of the holes in the partition 34*b* of the torch tip. Specifically, the holes 34*l* and 34*m* disposed radially outwardly of the circumferential boundary of mouth 34*d* add to the turbulence caused by the reduced diameter mouth and add to the instability and inefficiency of the gas burn occurring at the cross over point 22*a* immediately forwardly of the mouth. This, in turn, allows the nozzle to be more precisely dimensioned and designed to provide a precise burnout ratio for the nozzle tip. The fact that the various holes in the partition 34*b* are of different diameters also adds to the turbulence in the region between the partition and the mouth by virtue of the fact that the different diameter holes create different exit velocities at the downstream face of partition 34*b*.

The precise manner in which the invention torch tip functions to create flame blowout at a predetermined ratio of air pressure to gas pressure is not totally understood. However, it is clear that the reduced diameter mouth of the torch tip causes a plurality of individual gas streams travelling at varying velocities to cross over at cross over point 22*a*, and the resulting turbulence at point 22*a* is critical to the blowout of the flame. Combustion of a gas mixture comprised of methane and air can be shown by the following three equations:

$$2CH_4+2O_2=2CO+2H_2O+2H_2 \quad (1)$$

$$2CO+O_2=2CO_2 \quad (2)$$

$$2H_2+O_2=2H_2O \quad (3)$$

The first equation must of course occur first in time to generate the CO and $H_2$ that are essential for the second and third equations. The turbulence caused by the reduced diameter mouth apparently disrupts the sequence of the combustion formulas so that, as the air pressure and air supply is increased, the flame can no longer effectually burn. As previously indicated, the basic turbulence comes from the reduced diameter mouth and further turbulence is provided by the holes that are positioned in the outer periphery of the partition radially outwardly of the circumferential boundary of the reduced diameter mouth. The preferred shape for the inner surface of the main body portion of the torch tip is arcuate or a radius curve to provide the crossover behavior immediately forwardly of the mouth that is critical to providing the flame instability to control blowout. Again, the basic blowout characteristic is caused by the reduced diameter mouth and the increased turbulence added by the radially outer holes in the partition make the flame easier to blow out and more precisely controllable. Apparently as the air pressure is pumped up the secondary combustion formulas take place and the hydrogen is completely burned. The hydrogen causes the highest flame temperature and tends to form the frontal tip 22*b* of the cone in the primary burn region. The reduced diameter mouth causes portions of the flame front to flow outside of the normal combustion pattern. These disrupted portions cross the central axis of the flame at 22*a* and it is this crossing aspect that creates the turbulent, inefficient, unstable region in front of the torch tip that is critical to the blowout characteristic of the invention.

When the pressure ratio reaches a certain predetermined level, layers start forming in the flame front and the reduced diameter mouth blows the layers away. The turbulence created by the mouth prevents the formation of a hot flame since the layers typical of a hot flame are prevented from forming. The turbulence caused by the mouth and to a lesser extent by the holes behind the mouth prevent the normal burn sequence from occurring. The arcuate inner circumferential surface of the main body portion of the torch tip immediately upstream of the mouth functions to accelerate the gases and causes them to swirl. As noted, hydrogen is the last to burn in the burn sequence and burns at the tip of the flame. This tip usually will not form until the ratio of air pressure to gas pressure reaches at least 7 to 1. The invention torch tip has the effect of destroying the normal mechanics of the flame and prevents the flame tip or cone from forming.

In any event, the invention torch tip has been found to allow the torch tip to be specifically designed to provide a flame blowout at a precisely defined ratio of air pressure to gas pressure so that, with the invention torch tip in use, the operator of the die casting apparatus is precluded from indiscriminately jacking up the air pressure beyond a safe value in an attempt to optimize or speed up production. Specifically, if it is decided that the maximum primary burn temperature should be 1600° F. to minimize erosion of the metal of the nozzle and minimize overheating of the molten metal, the diameter of the mouth of the torch tip and the location and size of the holes in the partition are precisely chosen to provide a flame blowout at an air pressure to gas pressure ratio of 6:1 which corresponds to a flame temperature in the primary burn zone of 1600° F. If the operator attempts to jack up the air pressure beyond the 6:1 ratio, the invention nozzle tip operates automatically in response to such attempt to blowout the flame to preclude damage to the nozzle and overheating of the molten metal.

The invention nozzle tip also facilitates efficient and non-destructive heating of the nozzle by providing a flame that is significantly longer than conventional flames and in which the highest temperature zone, or primary burn zone, occurs in a small area at the tip of the flame. Thus, as illustrated in FIG. 1, the invention torch can be positioned relative to the nozzle to direct the flame into the cavity 17*a* of the die platen and position the primary burn zone of the flame precisely at the nose, or discharge end, of the nozzle where freeze-ups most typically occur and where, therefore, heat is most needed.

Specifically, the invention torch allows the creation of a long flame that burns at 800° to 1000° F. over the first six inches or so of the flame and in which the primary burn is actually an afterburn that occurs seven to twelve inches from the mouth of the torch. This long flame, with the hot primary burn precisely defined at the distal end of the flame, allows the flame to be aimed precisely into the cavity of the die to position the primary burn zone directly on the nose of the nozzle. This provides an improved and vastly more efficient way of heating the front or nose of the nozzle as compared to the prior art in which a very hot, relatively short, and relatively uniform geometry flame was directed against the main body of the nozzle at a location remote from the nose of the nozzle so that the heat could travel radially inwardly and axially forwardly along the nozzle to the nose of the nozzle.

Whereas a preferred embodiment of the invention has been illustrated and described in detail, it will be apparent that various changes may be made in the disclosed embodiment without departing from the scope or spirit of the invention.

I claim:

1. A torch tip for use in die casting applications, said tip comprising a unitary member including:

(A) an elongated tubular main body portion of generally uniform diameter and including an inlet end and a discharge end, said main body portion being adapted to be connected at its inlet end to a source of a combustible gas mixture;

(B) a single central partition portion extending rigidly and transversely across said main body portion intermediate said inlet end and said discharge end thereof defining an inlet chamber between one transverse side face of said partition portion and said inlet end thereof and a discharge chamber between the other transverse side face of said partition portion and said discharge end thereof;

(C) aperture means in said partition portion to allow said gas mixture to flow therethrough from said inlet chamber to said discharge chamber; and (D) means defining a mouth at said discharge end of said main body portion centered on the central axis of said main body portion and having a diameter less than the inner diameter of said main body portion at said other side face of said partition portion.

2. A torch tip according to claim 1 wherein:

(E) said aperture means includes a plurality of spaced holes in said partition portion with at least some of said holes disposed radially outwardly from the circumferential boundary of said mouth.

3. A torch tip according to claim 2 wherein:

(F) the inner diameter of said main body portion decreases gradually in diameter from a region downstream of said partition to said mouth.

4. A torch tip according to claim 1 wherein:

(E) said inlet end of said main body portion includes internal threads for connection with a suitable gas mixture supply pipe.

5. A torch tip according to claim 4 wherein:

(F) said tip is formed as a machined part.

6. An appartatus for limiting the temperature of the heat delivered to a nozzle of a die casting apparatus to avoid damaging the nozzle and avoid heating of the die cast metal above the temperature required for smooth flow, said apparatus comprising:

(A) a torch directed at the nozzle;

(B) a supply of pressurized air;

(C) a supply of a pressurized combustible gas;

(D) means for delivering said air and said gas to said torch in varying ratios of air pressure to gas pressure so that said air and said gas may be ignited to form a flame emitting from said torch for heating said nozzle; and (E) means sensitive to said pressure ratio and operative to extinguish said flame in response to an increase in said pressure ratio beyond a predetermined value;

(F) said pressure ratio sensitive means including mixing means within said torch operative to create a plurality of individual fuel streams within said torch of varying velocity and varying trajectory and further operative to cause said streams to cross over forwardly of said torch to create a turbulent unstable flame region at the cross over point representing an area of inefficient burn which functions to cause extinguishment of the flame upon an increase in pressure ratio beyond said predetermined value.

7. A torch tip for use in die casting applications comprising:

(A) an elongated tubular main body adapted to be connected at one end to a source of a combustible gas mixture;

(B) a partition extending transversely across said main body between the ends of said main body portion;

(C) means defining a mouth at the outer end of said main body having a diameter less than the inner diameter of said main body at said partition;

(D) aperture means in said partition to allow said gas mixture to flow therethrough and including a plurality of spaced holes with a least some of said holes disposed radially outwardly from the circumferential boundary of said mouth;

(E) the inner diameter of said main body decreasing gradually in diameter from a region downstream of said partition to said mouth;

(F) the annular end surface of said main body surrounding said mouth defining a sharp edge with the inner circumferential surface of said main body adjacent said mouth.

8. A torch tip according to claim 7 wherein:

(G) said sharp edge is constituted by an acute angle.

9. A unitary torch tip for use in die casting applications, comprising:

(A) a main body elongated tubular portion;

(B) a partition portion extending transversely of said main body portion intermediate the ends thereof and including at least one aperture therethrough for passage of a combustible gas mixture;

(C) means at one end of said main body portion for connecting said tip to a gas mixture supply pipe;

(D) a mouth at the other end of said tip centered on the central axis of main body portion and having a diameter less than the inner diameter of said main body portion at the downstream face of said partition portion;

(E) the inner diameter of said main body portion decreasing gradually in diameter from a region downstream of said partition portion to said mouth;

(F) the inner surface of said main body portion in the region of decreasing diameter being arcuate in longitudinal cross section and terminating in a sharp edge at the intersection thereof with the annular end surface of said main body portion surrounding said mouth.

10. A unitary torch tip according to claim 9 wherein:

(G) said partition portion includes a relatively large diameter central aperture and a plurality of circumferentially spaced relatively small diameter apertures disposed radially outwardly from the circumferential boundary of said mouth.

11. An apparatus for limiting the temperature of the heat delivered to a nozzle of a die casting apparatus to avoid damaging the nozzle and avoid heating of the die cast metal above the temperature required for smooth flow, said apparatus comprising:

(A) a torch directed at the nozzle;

(B) a supply of pressurized air;

(C) a supply of a pressurized combustible gas;

(D) means for delivering said air and said gas to said torch in varying ratios of air pressure to gas pressure so that said air and said gas may be ignited to form a flame emitting from said torch for heating said nozzle; and (E) means operative to extinguish said flame in response to an increase in said pressure ratio beyond a predetermined value;

(F) said torch including an elongated tubular torch tip having a transverse partition between its ends; and (G) extinguishing means comprising means defining a mouth at the discharge end of said tip having a diameter that is less than the inner diameter of said tip at said partition.

12. An apparatus according to claim 11 wherein:

(H) said extinguishing means further includes means defining a plurality of holes in said partition positioned radially outwardly from the circumferential boundary of said mouth.

* * * * *